US007681362B1

(12) United States Patent
Averitt

(10) Patent No.: US 7,681,362 B1
(45) Date of Patent: Mar. 23, 2010

(54) VENTED PANEL CONNECTOR

(76) Inventor: Randal K. Averitt, 6988 Terri St., Hosston, LA (US) 71043

( * ) Notice: Subject to any disclaimer, the term of this patent is extended or adjusted under 35 U.S.C. 154(b) by 0 days.

(21) Appl. No.: 12/228,178

(22) Filed: Aug. 11, 2008

(51) Int. Cl.
*E04B 2/88* (2006.01)
*E04B 2/28* (2006.01)
*E04B 2/00* (2006.01)

(52) U.S. Cl. ..... 52/169.12; 52/764; 52/DIG. 3; 52/302.1; 52/302.3; 52/459; 454/243; 454/339; 454/185

(58) Field of Classification Search ..... 52/302.1, 52/780, 781, 468, 764, 395, 396.04, 459, 52/460, 461, 462, 463, 464, 470, 471, 472, 52/275, 276, 278, 198, 199, 50, 220.1, 169.13, 52/169.5, 95, 169.12, 281, 282.1, 302.3, 52/582.1, 762, 763, 770, DIG. 3; 454/185, 454/186, 243, 353
See application file for complete search history.

(56) References Cited

U.S. PATENT DOCUMENTS

| | | | | | |
|---|---|---|---|---|---|
| 2,546,894 | A * | 3/1951 | Hodo | 52/630 |
| 3,113,357 | A * | 12/1963 | Reukauf et al. | 52/126.3 |
| 3,353,316 | A * | 11/1967 | Berg | 52/302.3 |
| 3,832,813 | A | 9/1974 | Hindman | 52/169 |
| 3,940,899 | A * | 3/1976 | Balinski | 52/481.1 |
| 4,159,844 | A | 7/1979 | Weiner | 296/37.1 |
| 4,214,412 | A | 7/1980 | Barylski | 52/169.12 |
| 4,352,261 | A | 10/1982 | Wargo | 52/169.12 |
| 4,549,378 | A | 10/1985 | Ayers et al. | 52/169.12 |
| 4,996,807 | A | 3/1991 | Walgamuth | 52/169.12 |
| 5,363,620 | A | 11/1994 | Lin | 52/482 |
| 5,611,185 | A * | 3/1997 | Wilz | 52/506.07 |
| 6,062,772 | A | 5/2000 | Perkins | 405/284 |
| 6,125,597 | A | 10/2000 | Hoffman et al. | 52/169.12 |
| 6,205,720 | B1 | 3/2001 | Wolfrum | 52/169.12 |
| 6,374,552 | B1 | 4/2002 | Price | 52/169.12 |
| 6,494,007 | B1 * | 12/2002 | Gembala | 52/395 |
| 6,691,471 | B2 | 2/2004 | Price | 52/169.12 |
| 6,711,870 | B1 * | 3/2004 | Richardson | 52/775 |
| 7,356,970 | B1 * | 4/2008 | Frobosilo | 52/261 |
| 2004/0006945 | A1 | 1/2004 | Price et al. | 52/605 |

* cited by examiner

*Primary Examiner*—Robert J Canfield
*Assistant Examiner*—Joseph J Sadlon
(74) *Attorney, Agent, or Firm*—R. Keith Harrison

(57) ABSTRACT

A vented panel connector for a decorative panel system includes a front plate, a pair of spaced-apart vent plates carried by the front plate, a pair of spaced-apart panel flanges extending from each of the pair of spaced-apart vent plates and a plurality of vent openings extending through each of the pair of vent plates between the front plate and the pair of spaced-apart panel flanges.

14 Claims, 6 Drawing Sheets

VENTED PANEL CONNECTOR

FIELD OF THE INVENTION

The present invention relates to walls and skirting systems for structures such as elevated homes and other buildings. More particularly, the present invention relates to a vented panel connector which may be a component part of a decorative panel system which can be used as a skirting system for an elevated structure or as a decorative addition to an interior or exterior wall of a building, for example.

BACKGROUND OF THE INVENTION

Elevated structures are structures which, rather than resting directly on a foundation, are spaced from the ground by pylons or supports intermittently spaced around the perimeter of the structure. Common types of elevated structures include mobile homes and manufactured houses. for example. In such elevated structures, a vertical gap separates the elevated floor of the structure from the ground. This gap frequently imparts an unsightly appearance to the structure. In many cases, therefore, it is desired to provide a decorative structure to span the gap between the ground and the floor of the elevated structure.

Various types of structures are known for spanning a vertical gap between the ground and the raised floor of an elevated structure. Retaining walls, for example, are typically solid concrete and extend around the perimeter of the elevated structure to support the structure above the ground. While they improve the appearance of an elevated structure somewhat, retaining walls are expensive to install and do not provide an impressionable surface on which various decorative designs can be imprinted. Moreover, retaining walls are heavy and difficult to position in place. Consequently, retaining walls are usually installed on-site during building of the elevated structure.

Therefore, there is a need for a decorative panel system which is inexpensive, lightweight, amenable to pre-fabrication and can be easily transported to an elevated structure for installation on existing structures or on structures being built.

SUMMARY OF THE INVENTION

The present invention is generally directed to a vented panel connector which is suitable for implementation with a decorative panel system used as a skirting system for an elevated structure or as a decorative addition to an interior or exterior wall of a building, for example. An illustrative embodiment of the vented panel connector includes a front plate, a pair of spaced-apart vent plates carried by the front plate, a pair of spaced-apart panel flanges extending from each of the pair of spaced-apart vent plates and a plurality of vent openings extending through each of the pair of vent plates between the front plate and the pair of spaced-apart panel flanges.

BRIEF DESCRIPTION OF THE DRAWINGS

The invention will now be described, by way of example, with reference to the accompanying drawings, in which.

DETAILED DESCRIPTION OF THE INVENTION

Figure 1:
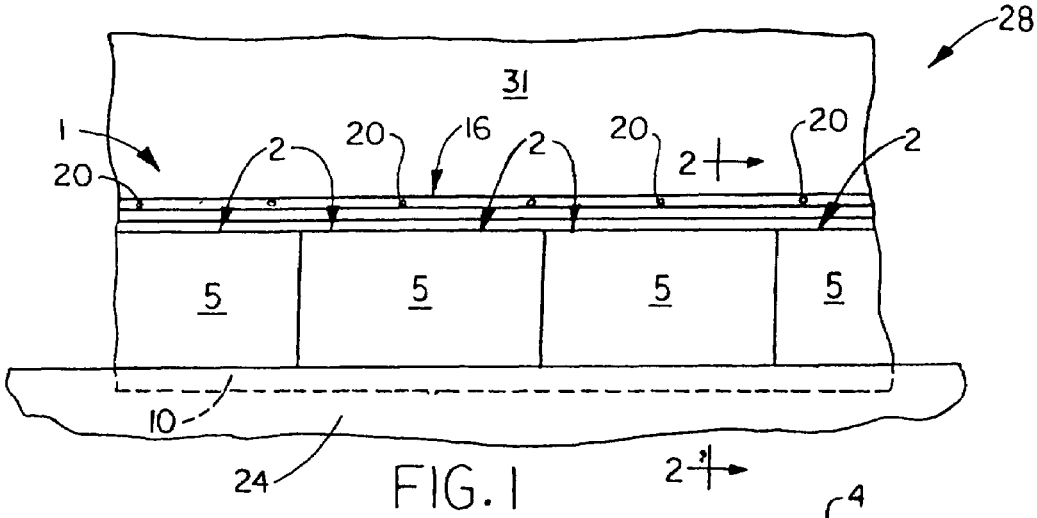
FIG. 1 is an exterior view of an elevated structure (partially in section), illustrating multiple interconnected panel units of the panel system according to the present invention.
Figure 2:
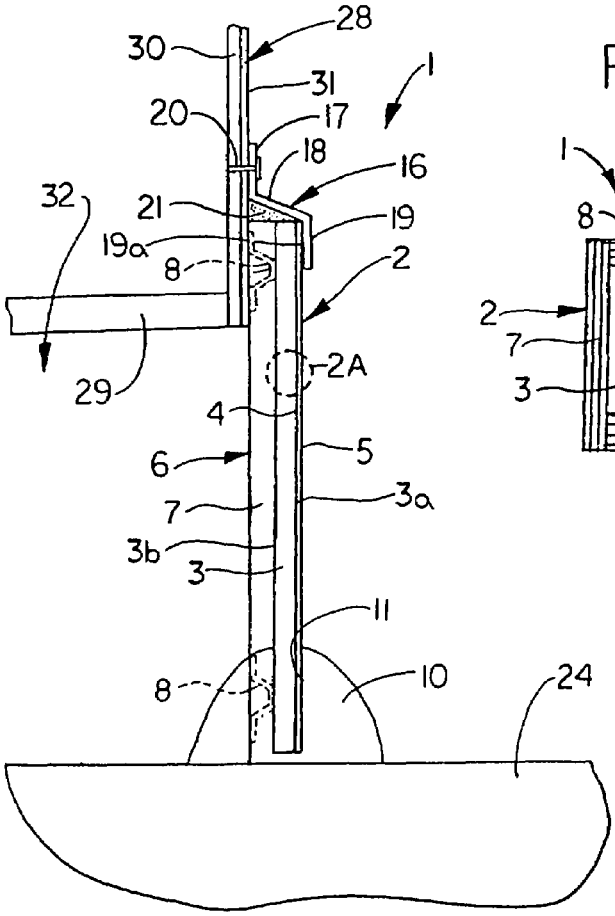
FIG. 2 is a cross-sectional view of a panel unit of the panel system, taken along section lines 2-2 in FIG. 1.

Referring initially to FIGS. 1-6 of the drawings, an illustrative embodiment of the panel system of the present invention is generally indicated by reference numeral 1. The panel system 1 is suitable to be used as a skirting system for an elevated structure 28, as shown in FIG. 1. As shown in FIG. 2, the elevated structure 28 may include horizontal floor joists 29, vertical wall studs 30 and multiple pylons or supports (not shown) extending between the ground 24 and the floor joists 29 to support the elevated structure 28 above the ground 24. A gap 32 is therefore defined between the ground 24 and the floor joists 29. In the particular application shown in the drawings, the panel system 1 is used as a skirting system to conceal the gap 32 and impart an aesthetically-pleasing appearance to the elevated structure 28. Furthermore, when used as a skirting system, the panel system 1 prevents the foraging of animals beneath the elevated structure 28. However, it is understood that the panel system 1 is suitable for a variety of alternative uses such as, for example, a decorative wall system for an interior or exterior wall (not shown) of a building.

Figure 3:
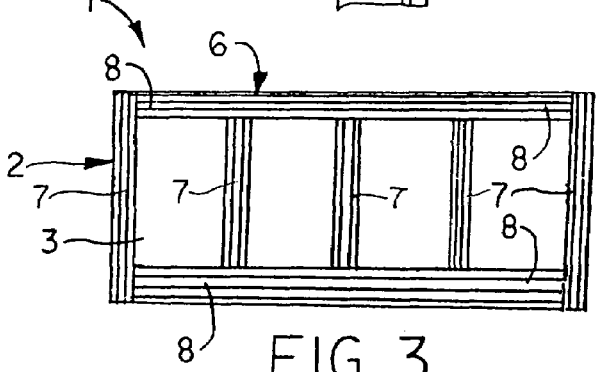
FIG. 3 is a rear view of a panel unit of the panel system.
Figure 5:
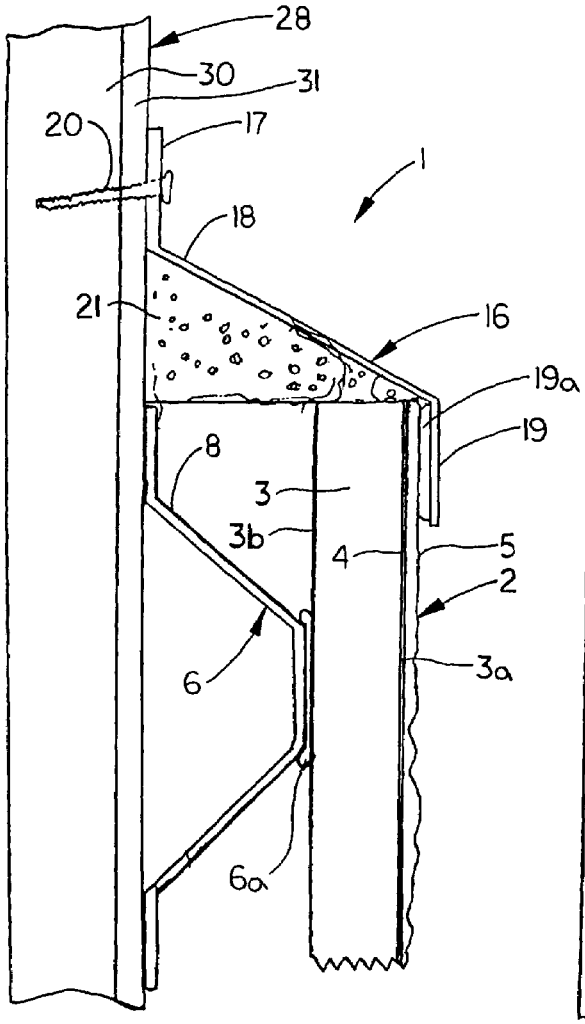
FIG. 5 is an enlarged cross-sectional view of the panel unit shown in FIG. 2, illustrating a resilient top cap insert to absorb settling pressure of an elevated structure on the panel unit.

The panel system 1 includes multiple panel units 2 which are interconnected to each other. Each of the panel units 2 may be rectangular in configuration, for example, and includes a support panel 3 having a front surface 3*a* and a rear surface 3*b*. The support panel 3 is typically a lightweight, firm cementitious material, although alternative materials which are firm and yet lightweight may be used instead. The support panel 3 is durable and resistant to natural elements and cracking under the influence of yard cutting apparatus such as weed trimmers, for example. A reinforcing frame 6 is typically provided on the rear surface 3*b* of the support panel 3 to stabilize and prevent inadvertent bowing and flexing of the support panel 3 in the assembled panel system 1. As shown in FIG. 3, the reinforcing frame 6 of each panel unit 2 may include multiple vertical frame members 7 and horizontal frame members 8, although the frame members may be arranged in any configuration which imparts multi-dimensional stability to the support panel 3. Each of the vertical frame members 7 and horizontal frame members 8 may be a channel beam, for example, or any alternative structural element which is suitable for preventing inadvertent horizontal and vertical bowing and flexing of the support panel 3. As shown in FIG. 5, each horizontal frame member 8 and vertical frame member 7 of the reinforcing frame 6 may be attached to the rear surface 3*b* of the support panel 3 by using a suitable liquid adhesive 6*a*, or by using an alternative technique known to those skilled in the art, such as threaded fasteners (not shown), for example. Preferably, the reinforcing frame 6 is a lightweight metal such as aluminum to facilitate easy transport and handling of each panel unit 2 and assembly of the panel units 2 into the panel system 1.

Figure 2A:
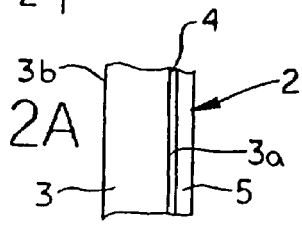
FIG. 2A is an enlarged, sectional view of a panel unit, taken along section line 2A in FIG. 2.

As shown in the cross-section of FIG. 2A, in construction of each panel unit 2, an bond coat 4 is applied to the front surface 3*a* of the support panel 3. In the assembled panel system 1, the front surface 3*a* will serve as the exterior surface of the panel unit 2. A decorative overlay 5 is spread over or poured, sprayed, stamped or otherwise applied on or to the bond coat 4. The decorative overlay 5 is a material which is initially impressionable when applied to the bond coat 4 and subsequently hardens or cures. A suitable example of the decorative overlay 5 is a cementitious material. Accordingly, after the decorative overlay 5 is applied to the bond coat 4 and while the decorative overlay 5 is still impressionable, any of various decorative design textures, such as those simulating the appearance of bricks, natural stones, rocks, wood or other structural elements, for example, are pressed, stamped or otherwise forged into the decorative overlay 5 using techniques which are known by those skilled in the art. The decorative overlay 5 then cures or hardens such that the forged designs remain therein. The decorative overlay 5 may alternatively or additionally be painted or otherwise colored according to the aesthetic desires of the user, after which a sealant (not shown) is typically applied to the decorative overlay 5.

It will be appreciated by those skilled in the art that the decorative overlay 5 may be applied to the support panel 3 and the designs formed in the decorative overlay 5 on-site where the panel system 1 is assembled. Alternatively, the panel units 2 may be pre-fabricated, the decorative overlay 5 impressioned and/or colored and sealed, and then the panel units 2 transported to the assembly or construction site, as desired. It will be further appreciated by those skilled in the art that the decorative overlay 5 is amenable to a variety of colors and textures which can be customized depending on the preferences of the user. Panel vents (not illustrated) may be provided in selected ones of the panel units 2 to facilitate venting the gap 32 enclosed by the assembled panel system 1 beneath the elevated structure 28. Access panels (not illustrated), which may be vented, may be provided in selected ones of the panel units 2 at selected spacings with respect to each other to provide access to the gap 32 beneath the elevated structure 28, as needed.

Figure 4:
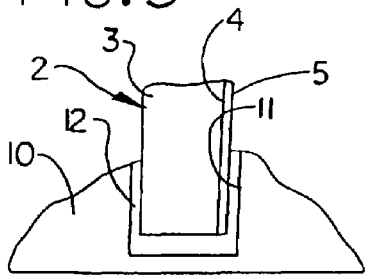
FIG. 4 is an enlarged cross-sectional view of an alternative embodiment of the panel unit shown in FIG. 2, illustrating a base insert provided in a panel base for the panel unit to facilitate removable insertion of the panel unit in the panel base.
Figure 6:
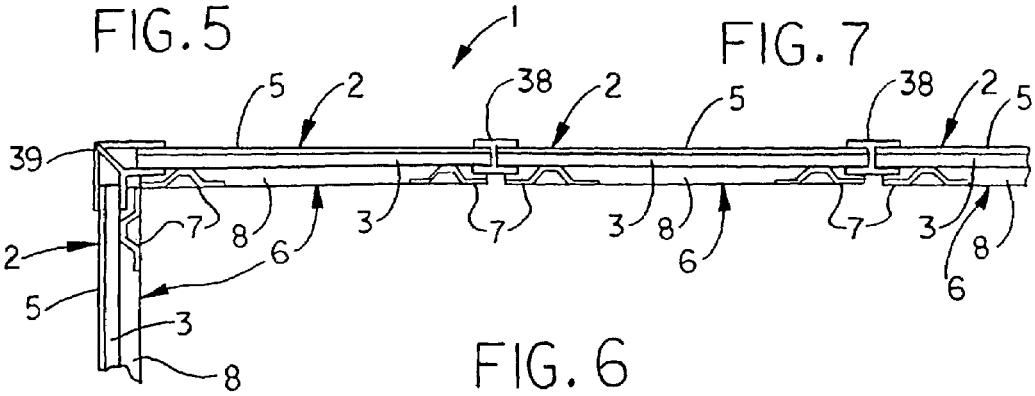
FIG. 6 is a top view, partially in section, of a panel system of interconnected panel units of the present invention, illustrating an illustrative technique of connecting adjacent panel units to each other in the panel system.

As shown in FIG. 2, in the assembled the panel system 1, the bottom edge of each panel unit 2 is typically anchored by a panel base 10, which may be concrete. The panel unit 2 is deposited on the ground 24, along the perimeter of the elevated structure 28, at a width and height which will facilitate anchoring of the vertical panel units 2 in the panel system 1 as well as level off inconsistencies in the contours of the ground 24. After deposition of the panel base 10, a panel slot 11 is troweled and evened out in the panel base 10 for receiving the lower edge of the panel unit 2. In one embodiment of the panel structure 1, which is shown in FIG. 2, one of the horizontal frame members 8 on the panel unit 2 is covered by the panel base 10 such that the horizontal frame member 8 anchors the panel unit 2 in the panel base 10 as the panel base 10 cures or hardens. This renders the panel system 1 permanent on the elevated structure 28. In another embodiment of the invention, which is shown in FIG. 4, a generally U-shaped base insert 12 is provided in the panel slot 11. The bottom edge of the panel unit 2 is removably inserted in the base insert 12 to render the panel system 1 portable on the elevated structure 28. This allows the panel unit 2 to be removed from the panel base 10 and replaced with a panel unit 2 having a different design, as desired, for example. As shown in FIG. 6, adjacent panel units 2 are connected to each other in the panel system 1 typically using one or multiple H-shaped straight panel connectors 38. Adjacent panel units 2 are connected to each other at the corners of the panel system 1 typically using one or multiple corner panel connectors 39.

As shown in FIGS. 1 and 2, the panel system 1 further includes an elongated top cap 16 which is attached typically to the vertical wall studs 30 of the elevated structure 28. An exterior wall finish 31 is typically provided on the elevated structure 28. The top cap 16 typically includes an attachment flange 17 which is attached to the elevated structure 28 typically using multiple fasteners 20, a sloped segment 18 which preferably extends downwardly at an obtuse angle with respect to the plane of the attachment flange 17, and a bottom lip 19 which extends from the sloped segment 18. As shown in FIG. 2, when the top cap 16 is mounted on the elevated structure 28, the bottom lip 19 applies inward pressure against the panel unit 2, which is typically attached to the interior surface of the bottom lip 19 using a liquid adhesive 19*a*, for example. The upper horizontal frame member 8 of the reinforcing frame 6 may engage the exterior wall finish 31 of the elevated structure 28. The sloped segment 18 provides a surface for runoff of rainwater and prevents leaking of rainwater into the gap 32. An elongated, resilient insert strip 21, which may be polystyrene or rubber, for example, is typically provided between the sloped segment 18 and the exterior wall finish 31 of the elevated structure 28. In the assembled panel system 1, the resilient insert strip 21 extends between the sloped segment 18 and the upper edge of the panel unit 2, and absorbs settling pressure caused by settling of the elevated structure 28 and exerted by the sloped segment 18 against the panel unit 2.

Figure 9:
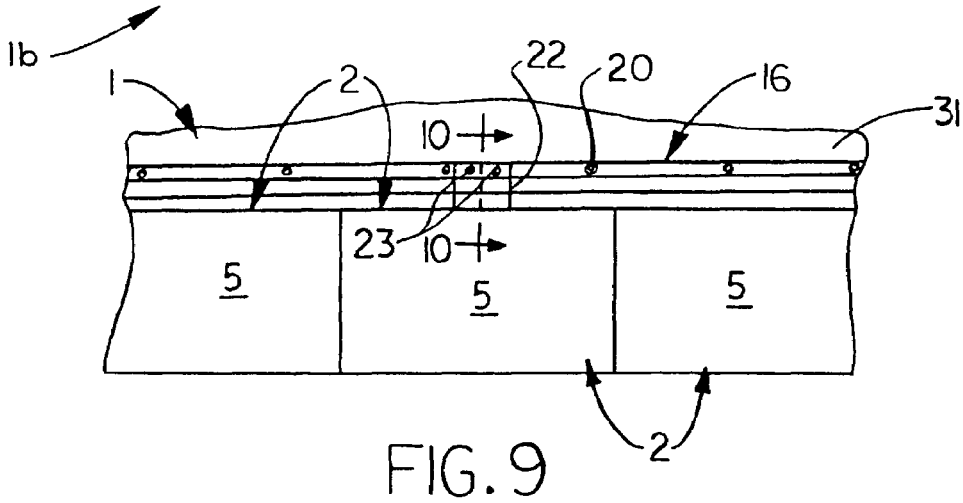
FIG. 9 is a front view of the panel system assembled on an elevated structure (in section), illustrating a to cap connector connecting adjacent segments of a top cap to each other.
Figure 10:
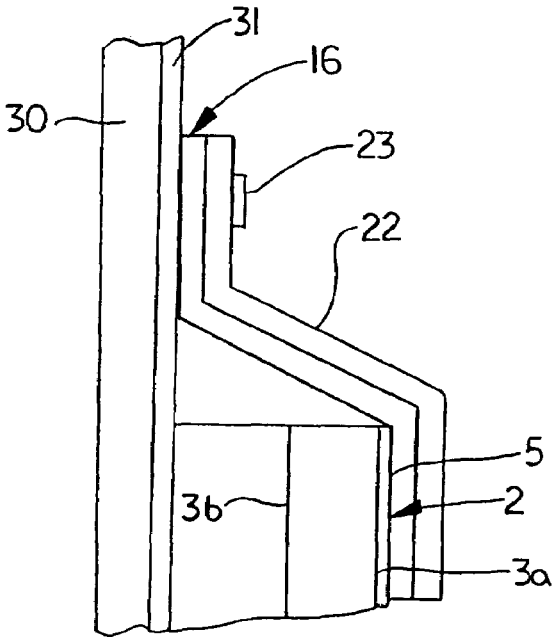
FIG. 10 is a cross-sectional view, taken along section lines 10-10 in FIG. 9, of the top cap connector and top cap.
Figure 11:
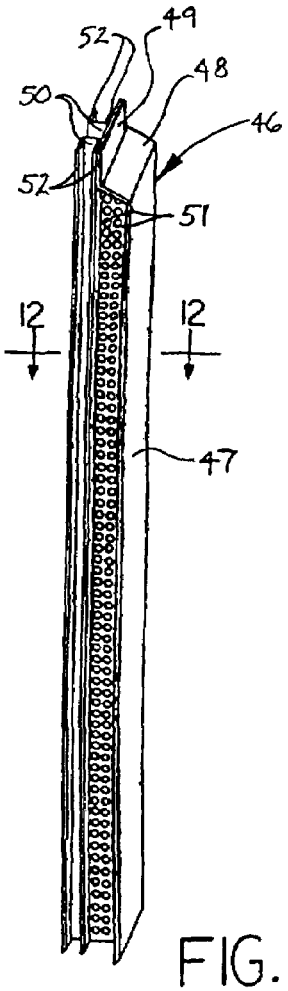
FIG. 11 is a perspective view of a vented panel connector which may connect adjacent panel units of the panel system.
Figure 12:
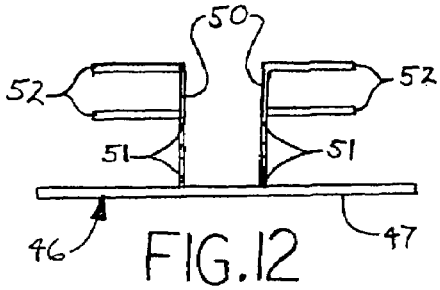
FIG. 12 is a cross-sectional view, taken along section lines 12-12 in FIG. 11, of the vented panel connector.

As illustrated in FIGS. 9 and 10, adjacent segments of the top cap 16 can be attached to each other using a top cap connector 22 having a cross-section which is complementary in shape to the cross-section of the top cap 16. A bolt 23 is extended through bolt openings in the top cap connector and each segment of the top cap 16 to connect the adjacent segments of the top cap 16 together in end-to-end relationship. The top cap 16 can be extended around corners of the elevated structure 28 using a corner top cap piece (not shown) which connects adjacent segments of the top cap 16 disposed at a 90-degree or other angle with respect to each other.

Figure 7:
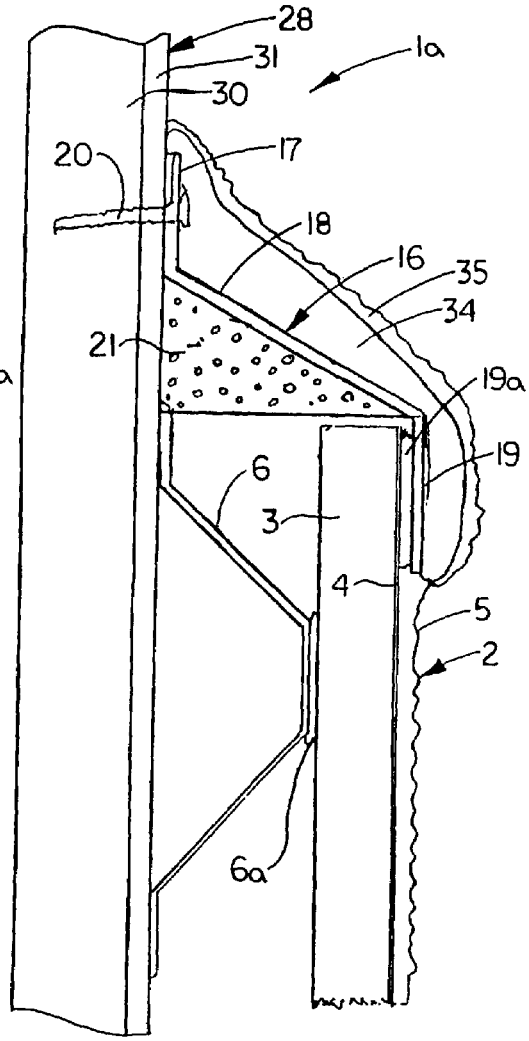
FIG. 7 is an enlarged cross-sectional view of an alternative embodiment of the panel unit shown in FIG. 2, illustrating a flexible base provided on the top cap element of the panel unit and a decorative overlay provided on the flexible base.

Referring next to FIG. 7, in another embodiment of the invention, the panel system 1*a* includes a flexible base 34, which may be a flexible metal or plastic, for example, on the top cap 16. A decorative overlay 35, which typically matches the material, design and color characteristics of the decorative overlay 5 on the panel unit 2, is provided on the flexible base 34. The decorative overlay 35 provides visual continuity between the panel units 2 and the top cap 16 of the panel system 1*a*.

Figure 8:
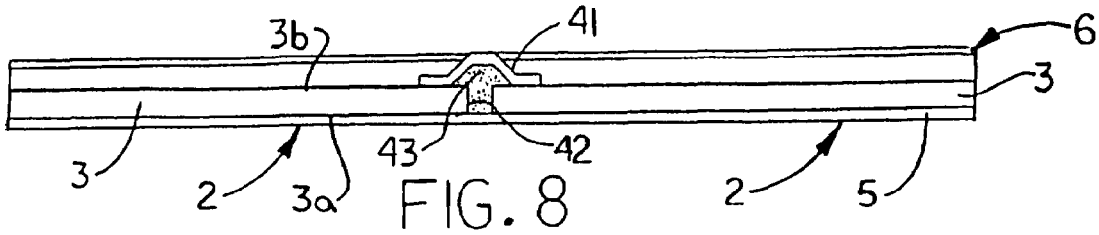
FIG. 8 is a top view of a pair of adjacent panel units in an alternative embodiment of the panel system according to the present invention, illustrating a seamless connection between the adjacent panel units.

Referring next to FIG. 8, in still another embodiment of the invention generally indicated by reference numeral 1*b*, the adjacent panel units 2 in the panel system 1*b* are connected to each other in such a manner as to provide a seamless appearance. Accordingly, a panel connecting beam 41, which may be a channel beam, for example, connects the adjacent panel units 2, with a vertical panel gap 42 between the adjacent panel units 2. A liquid adhesive (not shown) is typically used to mount the panel connecting beam 41 to the support panel 3 of each panel unit 2. The panel gap 42 is filled with grout 43, and the decorative overlay 5 is spread over both the front surface 3*a* of the support panel 3 and the exposed grout 43. Accordingly, the decorative overlay 5 presents a substantially seamless appearance between the adjacent panel units 2 in the panel system 1*b*.

Figure 13:
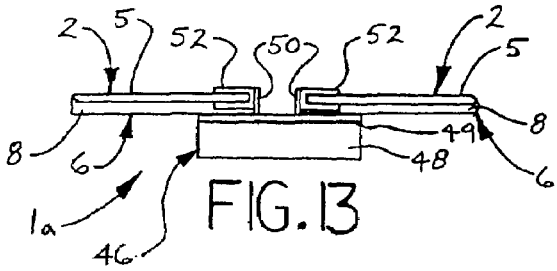
FIG. 13 is a top view of a vented panel connector connecting adjacent panel units to each other in the panel system.

Referring next to FIGS. 11-15 of the drawings, all or some of the straight panel connectors 38 which connect the adjacent panel units 2 to each other in the panel system 1 heretofore described with respect to FIGS. 1-10 may be replaced by vented panel connectors 46 in assembly of a panel system 1*a*, a portion of which is illustrated in FIG. 13. Accordingly, each pair of adjacent panel units 2 in the panel system 1*a* may be connected by a vented panel connector 46. Alternatively, the vented panel connectors 46 may alternate or be used intermittently with the straight panel connectors 38 to connect the adjacent panel units 2 to each other in the panel system 1*a*.

Each vented panel connector 46 may be injection-molded plastic, for example, and includes an elongated front plate 47. A beveled plate 48 angles from the upper edge of the front plate 47, and a top flange 49 extends upwardly from the beveled plate 48. A pair of parallel, spaced-apart vent plates 50 extends from the rear surface of the front plate 47, and each is generally coextensive with the front plate 47. A pair of parallel, spaced-apart panel flanges 52 extends outwardly from each vent plate 50. Multiple vent openings 51 extend through each vent plate 50, between the panel flanges 52 and the front plate 47.

Figure 15:
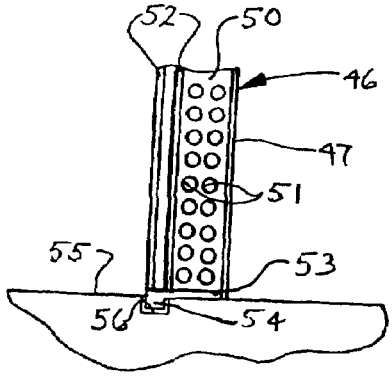
FIG. 15 is a side view, partially in section, of the bottom portion of the vented panel connector, illustrating a flange plate having a downwardly-protruding track flange provided on the bottom of the vented panel connector and the track flange inserted in a track provided in a panel support surface.

As illustrated in FIG. 15, in assembly of the panel system 1*a*, a panel support surface 55, such as concrete, may be provided on the ground to support the interconnected panel units 2. Accordingly, a flange plate 53, having a downwardly-extending track flange 54, may be provided along the bottom edge of each vented panel connector 46. A track 56 is provided in the panel support surface 55 and receives the track flange 54 of each vented panel connector 46 to secure the vented panel connector 46 to the panel support surface 55.

Figure 14:
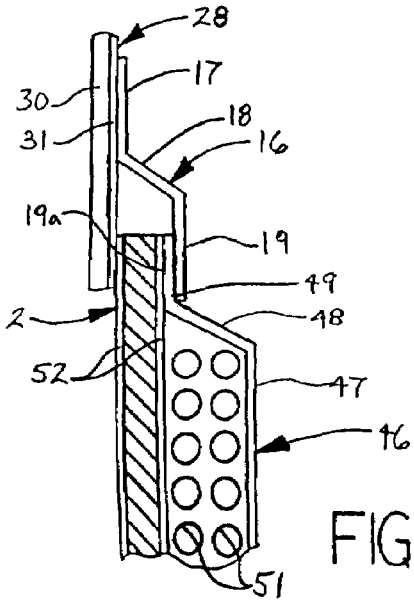
FIG. 14 is a side view, partially in section, of the top portion of the vented panel connector attached to a top cap mounted on the exterior of a wall.
Figure 16:
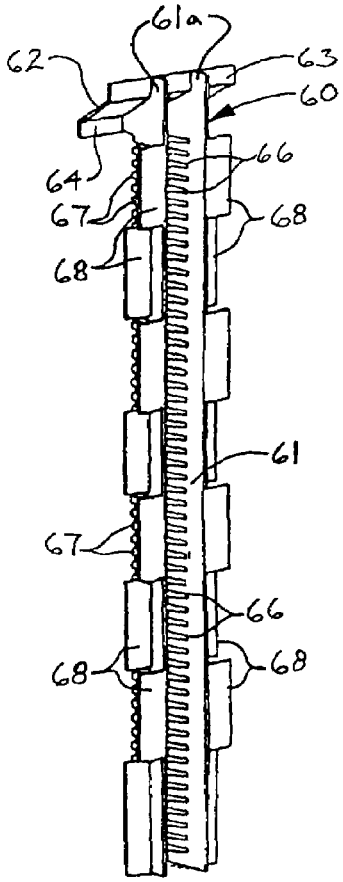
FIG. 16 is a rear perspective view of an alternative vented panel connector.
Figure 17:
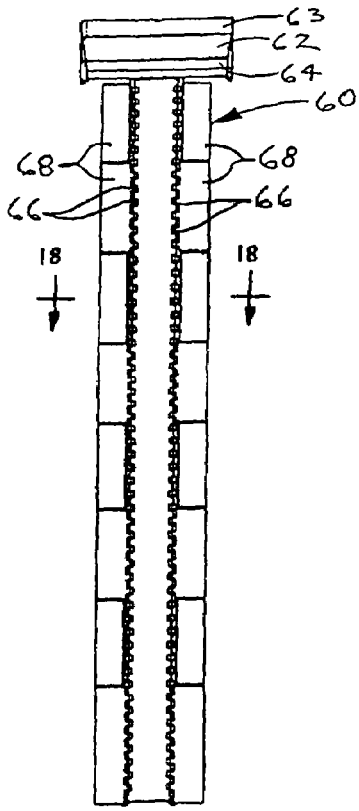
FIG. 17 is a front view of the vented panel connector.
Figure 18:
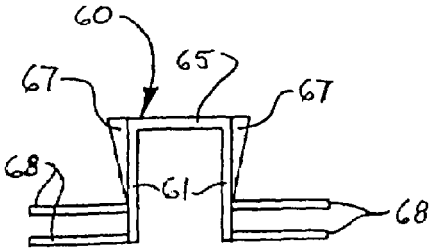
FIG. 18 is a cross-sectional view, taken along section lines 18-18 in FIG. 17, of the vented panel connector.
Figure 19:
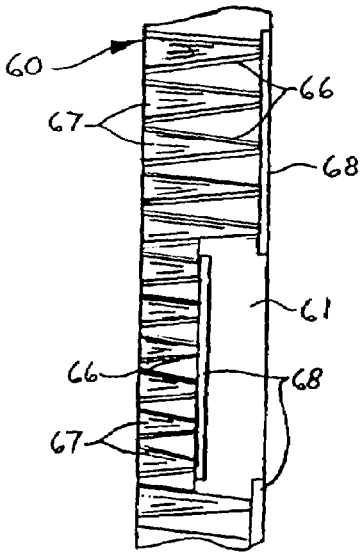
FIG. 19 is a side view, partially in section, of the vented panel connector.
Figure 20:
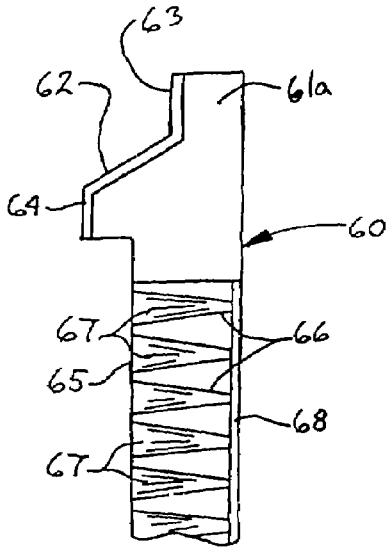
FIG. 20 is a side view, partially in section, of the top portion of the vented panel connector.

As illustrated in FIGS. 13 and 14, in assembly of the panel system 1*a*, the attachment flange 17 of a top cap 16 is attached to the elevated structure 28, as was heretofore described. The upper end of each of multiple vented panel connectors 46 is positioned between the exterior wall finish 31 of the elevated structure 28 and the bottom lip 19 of the top cap 16, as illustrated in FIG. 14. The top flange 49 of the vented panel connector 46 is secured to the bottom lip 19 of the top cap 16 using a suitable adhesive 19*a*. The track flange 54 (FIG. 15) provided along the bottom edge of each vented panel connector 46 is inserted in the track 56 provided in the panel support surface 55, as was heretofore described with respect to FIG. 15. Each panel unit 2 is inserted between the adjacent panel flanges 52 provided on each side of the vented panel connector 46. Accordingly, the vented panel connectors 46 interconnect the adjacent panel units 2 to each other in the panel system 1*a*. It will be appreciated by those skilled in the art that the gap 32 (FIG. 2) between the elevated structure 28 and the ground can be vented through the vent openings 51 of each vented panel connector 46. Furthermore, the vented panel connectors 46 eliminate the unsightly appearance of panel vents (not illustrated) which would otherwise be required in the panel units 2.

Figure 21:
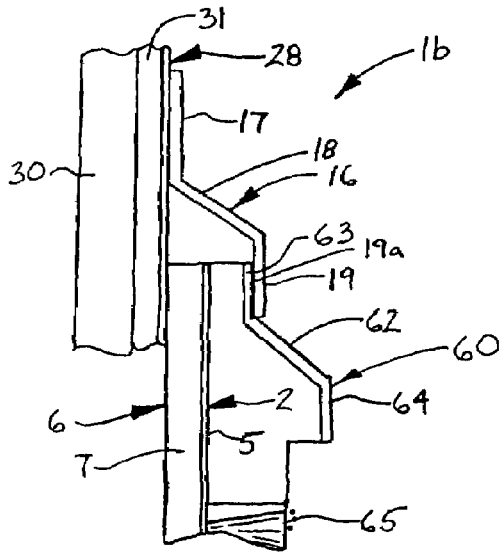
FIG. 21 is a side view, partially in section, of the top portion of the vented panel connector, attached to a top cap mounted on the exterior of a wall.
Figure 22:
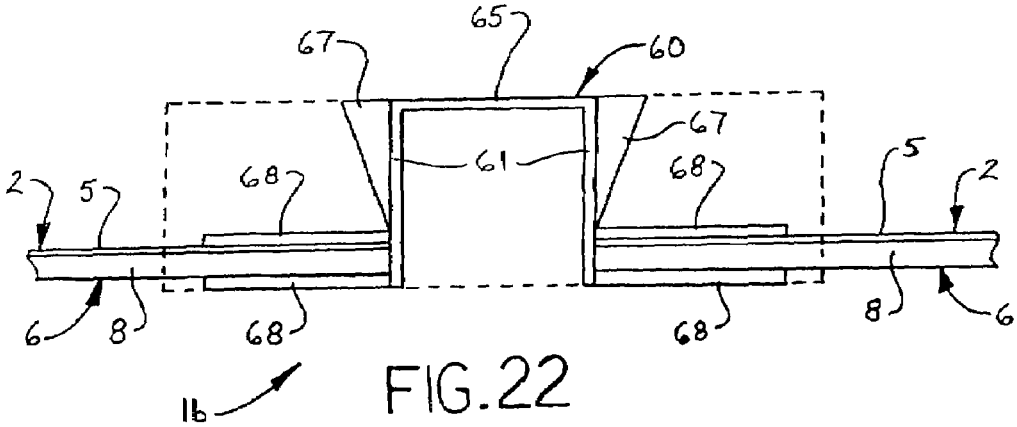
FIG. 22 is a top view of the vented panel connector connecting a pair of adjacent panel units in the panel system.

Referring next to FIGS. 16-22 of the drawings, an alternative design for a vented panel connector 60, multiple ones of which can be used to assemble a panel system 1*b*, a portion of which is illustrated in FIG. 22, is illustrated. Each pair of adjacent panel units 2 in the panel system 1*b* may be connected by a vented panel connector 60. Alternatively, the vented panel connectors 60 may alternate or be used intermittently with the straight panel connectors 38 (FIG. 6) to connect the adjacent panel units 2 to each other in the panel system 1*a*.

Each vented panel connector 60 may be injection-molded plastic, for example, and includes an elongated front plate 65. A pair of side plates 61, which are typically generally coextensive with the front plate 65, extends from opposite side edges of the front plate 65. A plate flange 61*a* terminates the upper end of each side plate 61. A sloped or beveled cap plate 62 is provided on the plate flanges 61*a*. A top flange 63 may extend upwardly from the upper edge of the cap plate 62, and a bottom flange 64 may extend downwardly from the lower edge of the cap plate 62. Multiple, generally parallel, spaced-apart vent slots 66 extend through each side plate 61. A slot fin 67 may extend from the exterior surface of each side plate 61, between adjacent vent slots 66, to guide the flow of air through the vent slots 66. Multiple panel mount flanges 68 extend outwardly from each side plate 61, in offset relationship to each other. A track flange 54 (FIG. 15) may be provided along the bottom edge of each vented panel connector 60 for insertion in a track 56 (FIG. 15) provided in a panel support surface 55, as was heretofore described with respect to the vertical panel connector 46 illustrated in FIG. 15.

As illustrated in FIGS. 21 and 22, in assembly of the panel system 1*b*, the attachment flange 17 of a top cap 16 is attached to the elevated structure 28, as was heretofore described. The upper end of each of multiple vented panel connectors 60 is positioned between the exterior wall finish 31 of the elevated structure 28 and the bottom lip 19 of the top cap 16, as illustrated in FIG. 21. The top flange 63 of the vented panel connector 60 is secured to the bottom lip 19 of the top cap 16 typically using a suitable adhesive 19*a*. Each panel unit 2 is inserted between the offset panel mount flanges 68 extending from each side of the vented panel connector 60. Accordingly, the vented panel connectors 60 interconnect the adjacent panel units 2 to each other in the panel system 1*b*. It will be appreciated by those skilled in the art that the gap 32 (FIG. 2) between the elevated structure 28 and the ground can be vented through the vent slots 66 of each vented panel connector 60.

While the preferred embodiments of the invention have been described above, it will be recognized and understood that various modifications can be made in the invention and the appended claims are intended to cover all such modifications which may fall within the spirit and scope of the invention.

Having described our invention with the particularity set forth above, I claim:

1. A vented panel connector, comprising:

a front plate;

a pair of spaced-apart vent plates carried by said front plate;

a pair of spaced-apart panel flanges extending from each of said pair of spaced-apart vent plates;

a plurality of vent openings extending through each of said pair of vent plates between said front plate and said pair of spaced-apart panel flanges and a beveled plate extending from said front plate.

2. The vented panel connector of claim 1 further comprising a top flange extending from said beveled plate.

3. The vented panel connector of claim 1 wherein said front plate, said pair of spaced-apart vent plates and said pair of spaced-apart panel flanges comprises plastic.

4. The vented panel connector of claim 1 wherein each of said plurality of vent openings is circular.

5. The vented panel connector of claim 1 in combination with a panel unit inserted between each of said pair of spaced-apart panel flanges.

6. The vented panel connector of claim 5 wherein said panel unit comprises a support panel and a decorative overlay carried by each of said support panels.

7. The vented panel connector of claim 6 further comprising a reinforcing frame carried by said support panel.

8. A vented panel connector, comprising:

a generally elongated, rectangular front plate;

a pair of generally elongated, parallel, spaced-apart vent plates carried by said front plate in generally perpendicular relationship with respect to said front plate;

a pair of generally elongated, parallel, spaced-apart panel flanges extending from each of said pair of spaced-apart vent plates;

a plurality of vent openings extending through each of said pair of vent plates between said front plate and said pair of spaced-apart panel flanges and a beveled plate extending from said front plate.

9. The vented panel connector of claim 8 further comprising a top flange extending from said beveled plate.

10. The vented panel connector of claim 8 wherein said front plate, said pair of spaced-apart vent plates and said pair of spaced-apart panel flanges comprises plastic.

11. The vented panel connector of claim 8 wherein each of said plurality of vent openings is circular.

12. The vented panel connector of claim 8 in combination with a panel unit inserted between each of said pair of spaced-apart panel flanges.

13. The vented panel connector of claim 12 wherein said panel unit comprises a support panel and a decorative overlay carried by each of said support panels.

14. The vented panel connector of claim 13 further comprising a reinforcing frame carried by said support panel.

* * * * *